US007806659B1

(12) United States Patent
Liang

(10) Patent No.: US 7,806,659 B1
(45) Date of Patent: Oct. 5, 2010

(54) TURBINE BLADE WITH TRAILING EDGE BLEED SLOT ARRANGEMENT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 726 days.

(21) Appl. No.: 11/827,078

(22) Filed: Jul. 10, 2007

(51) Int. Cl.
*F01D 5/08* (2006.01)
*F01D 5/18* (2006.01)

(52) U.S. Cl. ..... 416/97 R; 415/115

(58) Field of Classification Search ..... 415/115; 416/97 R
See application file for complete search history.

(56) References Cited

U.S. PATENT DOCUMENTS 4,180,373 A * 12/1979 Moore et al. ..... 416/97 R
4,601,638 A 7/1986 Hill et al.
5,368,441 A 11/1994 Sylvestro et al.
5,503,529 A * 4/1996 Anselmi et al. ..... 416/97 R
5,931,638 A * 8/1999 Krause et al. ..... 416/97 R
5,975,851 A 11/1999 Liang
6,174,135 B1 1/2001 Lee
6,257,831 B1 * 7/2001 Papple et al. ..... 416/97 R
6,273,682 B1 8/2001 Lee
6,551,063 B1 4/2003 Lee et al.
6,616,406 B2 9/2003 Liang
7,021,893 B2 * 4/2006 Mongillo et al. ..... 415/115
7,121,787 B2 10/2006 Jacks et al.

* cited by examiner

*Primary Examiner*—Igor Kershteyn
(74) *Attorney, Agent, or Firm*—John Ryznic

(57) ABSTRACT

A first stage turbine blade for an industrial gas turbine engine, the blade includes a row of exit slots along the trailing edge region of the blade to provide cooling. The exit slots are separated by ribs that also form diffusers in the slots. Each slot includes a constant metering inlet section followed by a diffuser section. The top most exit slot adjacent to the blade tip includes a rib angled at around 20 degrees toward the tip. The slots below the top most slot have ribs that are angled at around 15 degrees, then 10 degrees, and then 5 degrees before ending with the last slot in the group with a rib angled at zero degrees. The remaining exit slots below the tip group have ribs with ends that taper at from 3 degrees to about 7 degrees to form the diffusers.

12 Claims, 4 Drawing Sheets

TURBINE BLADE WITH TRAILING EDGE BLEED SLOT ARRANGEMENT

BACKGROUND OF THE INVENTION

1. Field of the Invention

The present invention relates generally to fluid reaction surfaces, and more specifically to a turbine blade with trailing edge cooling slots.

2. Description of the Related Art Including Information Disclosed Under 37 CFR 1.97 and 1.98

In a gas turbine engine, a hot gas flow is produced in the combustor and passed through the turbine to produce mechanical work in driving the rotor shaft. The turbine typically includes four stages of stator vanes and rotor blades to extract the maximum amount of energy from the flow. It is well known that, to increase the efficiency of the turbine and therefore the engine, a higher temperature gas flow can be passed into the turbine. However, the maximum allowable temperature passed into the turbine is generally a function of the material properties of the turbine airfoils and the amount of cooling of these airfoils.

In an industrial gas turbine (IGT) engine, efficiency is a major design factor for the engine. With the high cost of fuel to power the IGT, every increase in efficiency results in significant fuel savings because the engines burn a lot of fuel during the constant operation. The first stage turbine blades and stator vanes are exposed to the highest gas flow temperature in the turbine. As the turbine inlet temperature increases, the size of the first stage turbine blade increases. As the size of these blades grow, the prior art cooling circuits that produced adequate cooling becomes unacceptable.

In an IGT, long part life is also a major design factor due to the fact that an IGT typically operates continuously for 24,000 to 48,000 hours. Hot spots that occur on a portion of an airfoil can result in erosion and other damage to the airfoil that would result in a decrease in the performance of the part, reducing the efficiency of the engine. Hot spots occur where inadequate cooling occurs. Complex internal cooling circuitry has been proposed for providing convention cooling, impingement cooling and film cooling for the airfoils.

One portion of the IGT first stage turbine blade that has problems with inadequate cooling is the trailing edge blade tip. Typical prior art turbine blades have a tip corner on the trailing edge side of the blade that can be significantly under cooled, resulting in hot spots that lead to erosion damage and low performance.

It is therefore an object of the present invention to provide for a turbine blade with an improved trailing edge cooling circuit.

It is another object of the present invention to provide for a turbine blade with the elimination of the tip corner along the trailing edge.

It is another object of the present invention to provide for a large first stage turbine blade in an industrial gas turbine that will have an acceptable internal cooling circuit for the entire blade.

BRIEF SUMMARY OF THE INVENTION

A turbine blade for an IGT in the first stage in which the blade includes an internal cooling circuit having a 1-3-3 configuration with the leading edge region cooled by three rows of 20-30 degree radial angled diffusion or circular film cooling holes in conjunction with backside impingement. The mid-chord region is cooled by a pair of forward flowing triple-pass (3-pass) serpentine flow circuits with skew trip strips in a staggered array. The trailing edge region is cooled with a double impingement cooling circuit in conjunction with pressure side bleed or camber line discharge cooling exit metering diffusion slots with angled ribs are used in the blade trailing edge region to enhance local tip and root section cooling and flow distribution, eliminating the airfoil tip corner over temperature issue as well as blade root section cooling flow separation isse for the very first discharge slot.

The last four exit slots on the trailing edge at the tip are progressively angles from 5 degrees to 20 degrees in order to eliminate the tip corner along the trailing edge of the blade. The normal trailing edge exit cooling slot used in the middle span of the airfoil comprises of a metering entrance region following a diffusion region with a diffusion angle of from 3 to 7 degrees for the partition rib. The partition ribs for the mid section is extended straight along the airfoil streamline. However, for the first root section discharge slot, there is no diffusion at the bottom surface of the cooling slot. The bottom surface will be parallel to the blade platform surface. For this particular cooling slot, diffusion occurs on the top surface only. For the last tip discharge cooling slot, the partition rib corresponding to the pressure side bleed opening will be angled at about 20 degrees radial outward for the top surface and radial outward at 15 degrees for the bottom surface. The bottom surface for the slot next to the tip discharge slot will be angled radial outward about 10 degrees and the bottom surface for the subsequent slot will be angled at about 5 degrees.

DETAILED DESCRIPTION OF THE INVENTION

Figure 1:
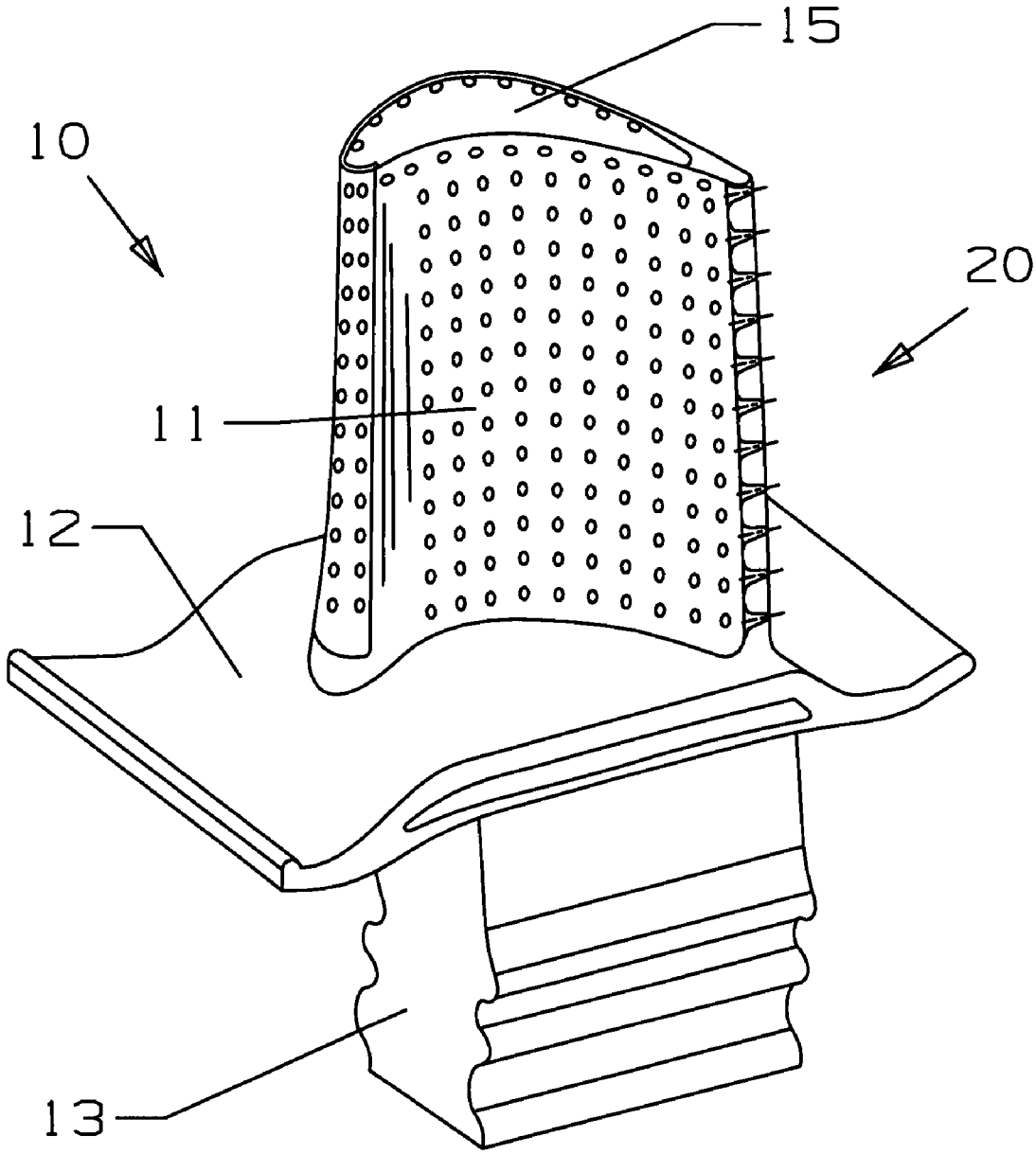
FIG. 1 is a profile view of the first stage turbine blade with the cooling circuit of the present invention.

A first stage turbine blade for use in an industrial gas turbine engine is shown in FIGS. 1 through 4. The turbine blade 10 includes an airfoil portion 11 extending from a root portion 13 with a platform 12 formed between the two portions. A blade tip 15 is formed at the top of the airfoil 11 to form a seal between the blade and the outer shroud of the engine casing. A row of exit slots 20 is arranged along the trailing edge to provide cooling for this region of the blade.

Figure 2:
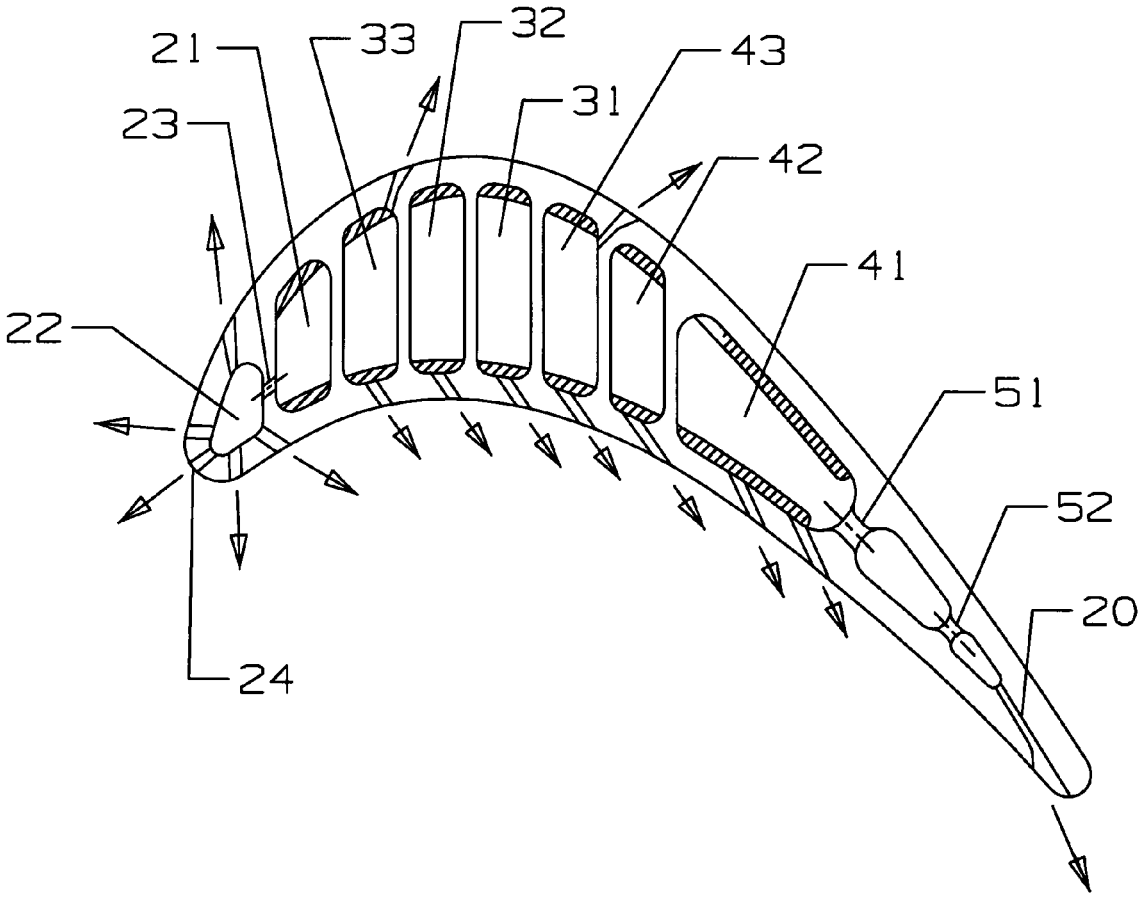
FIG. 2 shows a cross section of a cut-away view of the internal blade cooling circuit.

FIG. 2 shows a cross section view of the blade cooling configuration. The leading edge region is cooled with a leading edge cooling supply channel 21 that supplies cooling air to the blade, a row of metering holes 23 connects the supply channel 21 to a leading edge impingement cavity 22 which is connected to a showerhead arrangement of film cooling holes 24 and pressure side and suction side gill holes to provide film cooling on both sides of the leading edge region of the blade. The leading edge section is cooled by three rows of 20 to 30 degree radial angled diffusion or circular film cooling holes in conjunction with backside impingement. Coolant air is fed into the airfoil through a single pass radial channel 21 and impinges onto the airfoil inner wall of cavity 22 from the passage through a row of crossover metering holes 23. The spent air is then discharged through the showerhead 24 and the pressure side and suction side gill holes. Skew trips strips are used on the pressure and suction inner walls of the coolant channel to augment the internal heat transfer performance. Multi-compartments can also be used in the leading edge impingement channel 22 to regulate the pressure ratio across the leading edge showerhead, eliminating showerhead film blow-off problem and achieving optimum cooling performance with adequate backflow pressure and minimum cooling flow.

Figure 3:
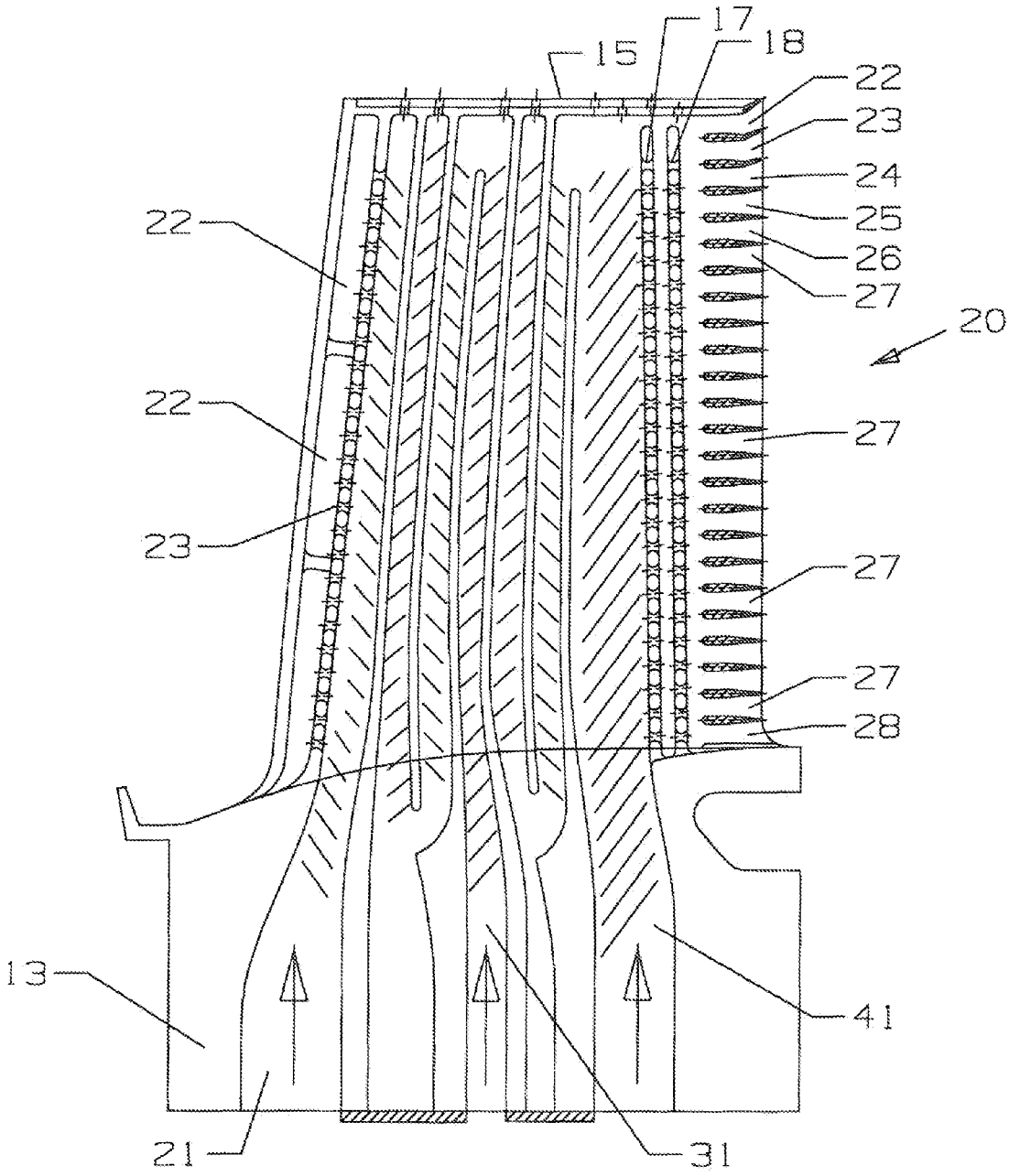
FIG. 3 shows a blade profile view of the internal cooling circuit.

FIG. 3 shows the blade profile view with the mid-chord region cooling circuits. A pair of forward flowing triple-pass serpentine flow circuits provides cooling for the mid-chord region of the airfoil. A first or forward triple-pass serpentine flow circuit includes a first leg or supply channel 31, a second leg 32 and a third leg 33 arranged in a serpentine flow path. FIG. 2 shows a row of pressure side film cooling holes connected to all three of the passages in the forward serpentine flow circuit to provide film cooling for the pressure side surface of the airfoil. The last leg 33 of the forward serpentine flow circuit includes a row of film cooling holes for the suction side of the airfoil.

FIG. 3 also shows second or aft triple-pass serpentine flow circuit includes a first leg or supply channel 41, a second leg 42 and a third leg 43 arranged in a serpentine flow path. The first leg 41 includes two rows of film cooling holes arranged along the pressure side, the second leg 42 includes one row of film cooling holes arranged along the pressure side, and the last or third leg 43 includes one row of film cooling holes arranged along the pressure side and one row of film cooling holes arranged along the suction side of the airfoil. The first leg 41 of the aft serpentine flow circuit also supplies cooling air to the trailing edge cooling circuit 20.

Skew trip strips in a staggered array are used on both the pressure and suction inner walls to augment the internal heat transfer performance. Compound oriented multi-diffusion film cooling holes are used on the external pressure and suction surfaces. Half root turn cooling flow concept is incorporated in the triple pass serpentine. The serpentine core is extended from the half root turn to the blade inlet region for core support and possible future cooling air addition.

The trailing edge region of the blade is cooled with a double impingement cooling circuit in conjunction with pressure side bleed or camber line discharge cooling for the trailing edge region. FIG. 3 also shows the trailing edge cooling circuit with a first row of impingement holes 17 and a second row of impingement holes 18 located downstream from the first row of impingement holes 17. Cooling air is fed through the first up-pass or leg 41 of the second triple-pass serpentine flow circuit. Cooling air is impinged onto the first trailing edge rib 17 and then the second trailing edge rib 18 prior to being discharged into the airfoil pressure side surface through the pressure side bleed slots or discharged through a series of cooling slots located along the airfoil camber line.

Figure 4:
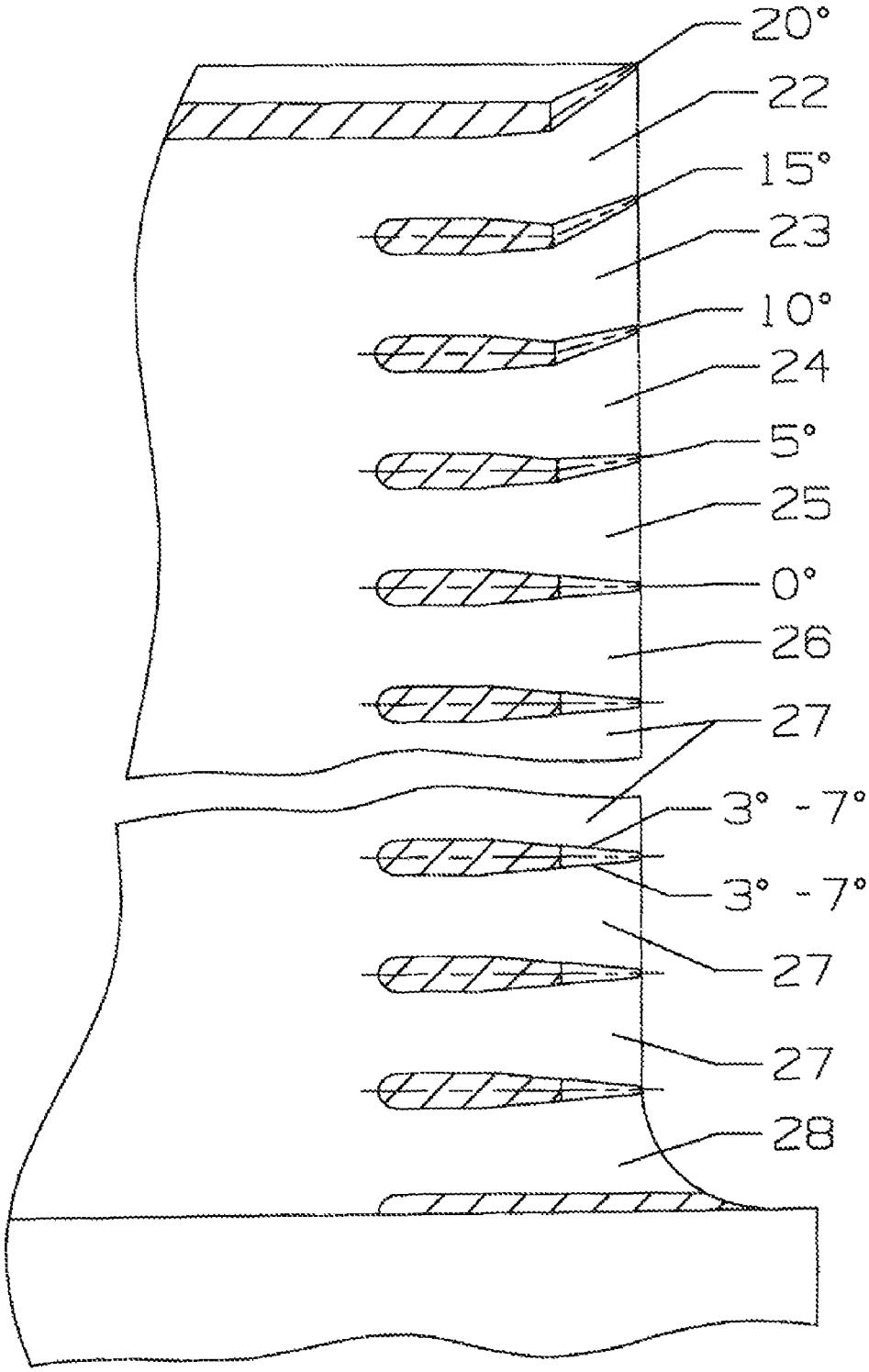
FIG. 4 shows a detailed view of the blade trailing edge cooling circuit at the tip and at the platform.

The exit slots along the trailing edge form a diffusion passage as shown in the FIG. 4. Each exit slot is formed by adjacent ribs that extend substantially perpendicular to the trailing edge. The adjacent ribs that form an exit slot have a constant metering inlet section with a diffusion section immediately downstream as seen in FIGS. 3 and 4. The slot 28 nearest to the platform or root fillet has a flat bottom surface that forms no diffusion. The top surface of the bottom slot 28 is angled from about 3 degrees to about 7 degrees with respect to the flat surface of the bottom surface of the slot 21. Each of the exit slots 27 from the first slot 28 up to the slot 26 in FIG. 4 has a bottom surface and a top surface angled from about 3 degrees to about 7 degrees to form a diffuser in the exit slots 27.

The remaining slots above the top most slot 27 form a progressively increasing diffusion angle as described next. Exit slots 22 through 26 are referred to as the tip region slots because they form a progressively increasing diffusion, increasing from zero in slot 26 to 20 degrees in slot 22. The slot 26 above the top-most slot 27 has a bottom surface angled from about 3 degrees to about 7 degrees and a top surface angled from about 3 degrees to about 7 degrees. The slot 25 has a bottom surface at zero angle and a top surface of about 5 degrees. The slot 24 has a bottom surface of about 5 degrees and a top surface of about 10 degrees. The slot 23 has a bottom surface of about 10 degrees and a top surface of about 15 degrees. The slot 22 has a bottom surface of about 15 degrees and a top surface of about 20 degrees. Thus, the diffusion slots from slot 25 to slot 22 form a progressively increasing diffusion angle toward the tip in order that the tip angle can be around 20 degrees in order to eliminate the tip corner as seen in FIG. 4.

The exit metering diffusion with angled ribs have been used in the blade trailing edge region to enhance local tip and root section cooling and flow distribution. The cooling design of the present invention eliminates the airfoil tip corner overtemperature issue as well as blade root section cooling flow separation issue for the very first discharge slot. The normal trailing edge exit cooling slot used in the middle span of the airfoil comprises of a metering entrance region followed by a diffusion region with a different angle in the range of from about 3 degrees to about 7 degrees angle for the partition rib. The partition rib for the mid section is extended straight along the airfoil streamline. However, for the first root section discharge slot, there is no diffusion at the bottom surface of the cooling slot. The bottom surface will be parallel to the blade platform surface. For this particular cooling slot, diffusion occurs on the top surface only.

I claim the following:

1. A first stage turbine blade for use in an industrial gas turbine engine, the blade comprising:

a leading edge cooling supply channel;

a leading edge impingement cavity connected to the leading edge supply channel through at least one metering hole;

a showerhead arrangement of film cooling holes connected to the leading edge impingement cavity;

a first forward flowing triple-pass serpentine flow cooling circuit located adjacent to the leading edge cooling supply channel;

a second forward flowing triple-pass serpentine flow cooling circuit located adjacent to the trailing edge region of the blade;

a first row of impingement cooling holes connected to the first leg of the second forward flowing triple-pass serpentine flow cooling circuit;

a second row of impingement cooling holes located downstream from the first row of impingement cooling holes;

a row of exit slots extending along the trailing edge of the blade, the exit slots having ribs forming a diffuser; and, the exit slots near the blade tip form a diffuser that progressively increases in the direction toward the blade tip.

2. The turbine blade of claim 1, and further comprising:

the exit slots adjacent to the blade tip each form a diffuser that progressively increases in the direction toward the blade tip.

3. The turbine blade of claim 2, and further comprising:

the top-most exit slot adjacent to the blade tip includes an upper rib with an angle of about 20 degrees such that a blade tip corner is eliminated.

4. The turbine blade of claim 3, and further comprising:

the top four exit slots have ribs with angles from about zero degrees to about 20 degrees with increments of about 5 degrees between adjacent ribs.

5. The turbine blade of claim 4, and further comprising:

the exit slots below the top four exit slots have ribs with angles from about 3 degrees to about 7 degrees.

6. The turbine blade of claim 5, and further comprising:

the lower-most exit slot adjacent to the root portion of the blade has a bottom rib with zero diffusion.

7. The turbine blade of claim 1, and further comprising:

the exit slots include a constant metering inlet section and a diffuser outlet section.

8. The turbine blade of claim 1, and further comprising:

the exit slots include a constant metering inlet section and a diffuser outlet section.

9. A turbine rotor blade comprising:

a leading edge and a trailing edge;

a pressure side wall and a suction side wall where both walls extend between the leading edge and the trailing edge;

a multiple pass serpentine flow cooling circuit;

the trailing edge having a row of exit diffusion slots extending from a platform to a blade tip;

each exit diffusion slot having an inlet section and an outlet diffusion section;

the inlet sections for the exit slots are all straight and parallel to a chordwise direction of the blade; and, the exit diffusion slots near the blade tip include the outlet diffusion sections with ribs that progressively slants upward in the direction toward the blade tip.

10. The turbine rotor blade of claim 9, and further comprising:

the exit diffusion slot at the blade tip provides convection cooling to the blade tip.

11. The turbine rotor blade of claim 9, and further comprising:

the lower-most exit diffusion slot adjacent to the root portion of the blade has a bottom rib with zero diffusion.

12. The turbine rotor blade of claim 9, and further comprising:

the top four exit diffusion slots have ribs with angles from about zero degrees to about 20 degrees with increments of about 5 degrees between adjacent ribs.

* * * * *